US005697561A

United States Patent [19]

Plank et al.

[11] Patent Number: 5,697,561

[45] Date of Patent: Dec. 16, 1997

[54] MODULAR ICE CRUSHER FOR USE WITH AN ICE STORAGE UNIT

[75] Inventors: Robert G. Plank, Denver; Ralph E. Williams, Littleton, both of Colo.

[73] Assignee: Kloppenburg & Company, Englewood, Colo.

[21] Appl. No.: 707,099

[22] Filed: Sep. 3, 1996

[51] Int. Cl.[6] ..... B02C 23/00

[52] U.S. Cl. ..... 241/100; 241/101.4; 241/DIG. 17

[58] Field of Search ..... 241/100, 285.2, 241/243, DIG. 17, 101.4; 248/225.11, 674

[56] References Cited

U.S. PATENT DOCUMENTS

| | | | |
|---|---|---|---|
| 1,724,403 | 8/1929 | Hutchinson | 241/100 X |
| 2,643,065 | 6/1953 | Clawson | 241/DIG. 17 X |
| 2,645,910 | 7/1953 | Leeson | 241/DIG. 17 X |
| 2,700,563 | 1/1955 | Krucker | 248/225.11 X |
| 2,952,391 | 9/1960 | Garland | 241/DIG. 17 X |
| 3,135,101 | 6/1964 | Nigro | 62/344 |
| 4,168,805 | 9/1979 | Taylor | 241/DIG. 17 X |
| 4,228,923 | 10/1980 | Barnard | 222/52 |
| 4,706,466 | 11/1987 | Yingst et al. | 62/344 |
| 5,061,167 | 10/1991 | Hehl | 241/101.4 X |
| 5,131,620 | 7/1992 | Boundy | 248/674 |
| 5,190,228 | 3/1993 | Ficken et al. | 241/100 |
| 5,211,030 | 5/1993 | Jameson | 62/344 |
| 5,397,032 | 3/1995 | Landers | 222/146.6 |
| 5,445,332 | 8/1995 | Shimizu et al. | 241/100 X |

*Primary Examiner*—Daniel W. Howell
*Assistant Examiner*—Julie A. Krolikowski
*Attorney, Agent, or Firm*—Dorr, Carson, Sloan & Birney, P.C.

[57] ABSTRACT

A modular ice crusher assembly for use in conjunction with an ice storage unit can be easily removed for cleaning or maintenance. Two parallel brackets are used to mount and support the ice crusher below the discharge opening for the ice storage unit. A release mechanism allows the ice crusher to slide relative to the brackets between a first position in which the inlet chute of the ice crusher is in vertical alignment with the opening of the ice storage unit for receiving ice to be chipped, and a second position in which the ice crusher can be removed for cleaning or service. For example, the release mechanism can consist of a series of pins extending laterally outward from the ice crusher housing that slideably engage a corresponding series of inverted L-shaped slots in the brackets. During normal operation, the ice crusher is held in position below the ice storage unit because the pins are supported in the horizontal portions of the slots. However, if the user slides the ice crusher forward, the pins will slide until they enter the vertical portions of the slot, and at this point the ice crusher will drop off the brackets. A sliding gate permits the user to selectively open and close the inlet chute to the ice storage unit and thereby control the flow of ice into the ice crusher.

13 Claims, 7 Drawing Sheets

MODULAR ICE CRUSHER FOR USE WITH AN ICE STORAGE UNIT

BACKGROUND OF THE INVENTION

1. Field of the Invention

The present invention relates generally to the field of ice crushers. More specifically, the present invention discloses a modular ice crusher that can be attached to a conventional ice storage unit of the type widely used in restaurants and institutional kitchens.

2. Statement of the Problem

Ice storage units have been widely used in restaurants and institutional kitchens for many years to hold and dispense ice. One common type of ice storage unit consists of storage bin that is supported a distance above the floor so that a removable cart can be placed beneath the unit to receive ice. The ice storage unit often includes an ice maker for creating ice cubes and delivering them into the storage compartment within the unit. The storage compartment is usually insulated to help maintain a temperature below freezing within the storage compartment. The ice storage unit includes a lower opening with a gate mechanism for dispensing ice into the cart. Several types of gate mechanism are in use, but the most common is simply a planar gate that slides between two parallel tracks mounted on opposing sides of the bottom opening to the ice storage unit. The ice storage unit may also be equipped with hinged front doors for additional access to the ice stored within.

Conventional ice storage units dispense ice in the form that it is created by the ice maker within the unit (i.e., usually ice cubes). However, it is sometimes more desirable to dispense crushed ice or chipped ice for use in cold drinks or as a bed for a salad bar, produce, or meats. Therefore, a need exists for an ice storage unit that can dispense crushed ice as well as ice cubes.

If an ice crusher is attached to an ice storage unit, health and sanitation requirements dictate that the ice crusher must be readily accessible for periodic cleaning and maintenance. This can be difficult to achieve with a conventional ice storage unit, given the space constraints within the ice storage bin and under the unit.

The prior art in the field of ice crushers and ice storage units includes the following:

| Inventor | Patent No. | Issue Date |
|---|---|---|
| Nigro | 3,135,101 | June 2, 1964 |
| Barnard | 4,228,923 | Oct. 21, 1980 |
| Yingst | 4,706,466 | Nov. 17, 1987 |
| Jameson | 5,211,030 | May 18, 1993 |
| Landers | 5,397,032 | Mar. 14, 1995 |

Nigro discloses a flexible tray assembly for freezing and storing ice chips. A division plate 50 separates the two compartments within the tray assembly. This division plate is removed by pulling its handle 59.

Landers discloses a drop-in beverage and ice dispenser with a removable drain pan shown.

Barnard shows an ice maker dispenser with a removable chute. An interlock mechanism prevents the "closure member" from opening when the chute is removed from the ice maker for servicing, etc.

Jameson discloses a ice storage unit that has a gate mechanism for releasing ice into a portable cart below. The gate includes drainage means for directing any ice melt from the storage area into a drain at the rear of the unit. The cart also includes a front-actuated draining mechanism to discharge any ice melt accumulating in the cart into the drain at the rear of the unit.

Yingst et al. disclose an under-the-counter ice making machine with a removable freezer compartment. The freezer compartment slides forward relative to the base for cleaning or repair.

3. Solution to the Problem

None of the prior art references uncovered in the search show a removable ice crusher for an ice storage unit that includes both a gate to control the flow of ice from the storage bin into the ice crusher, and a release mechanism that allows the ice crusher to be easily removed from the ice storage unit for cleaning and maintenance.

SUMMARY OF THE INVENTION

This invention provides a modular ice crusher assembly for use in conjunction with an ice storage unit. Two parallel brackets are used to mount and support the ice crusher below the discharge opening for the ice storage unit. A release mechanism allows the ice crusher to slide relative to the brackets between a first position in which the inlet chute to the ice crusher is in vertical alignment with the opening of the ice storage unit for receiving ice to be chipped, and a second position in which the ice crusher can be removed for cleaning or service. For example, the release mechanism can consist of a series of pins extending laterally outward from ice crusher housing that slideably engage a corresponding series of inverted L-shaped slots in the brackets. During normal operation, the ice crusher is held in position below the ice storage unit because the pins are supported in the horizontal portions of the slots. However, if the user slides the ice crusher forward, the pins will slide until they enter the vertical portions of the slot, and at this point the ice crusher will drop off the brackets. A sliding gate permits the user to selectively open and close the inlet chute to the ice storage unit and thereby control the flow of ice into the ice crusher.

A primary object of the present invention is to provide an ice crusher assembly that can be readily fitted to a conventional ice storage unit.

Another object of the present invention is to provide an ice crusher assembly that can be easily removed from the ice storage unit for cleaning or service.

Yet another object of the present invention is to provide an ice crusher assembly that can be easily retrofitted to existing ice storage units with only minimal modifications.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
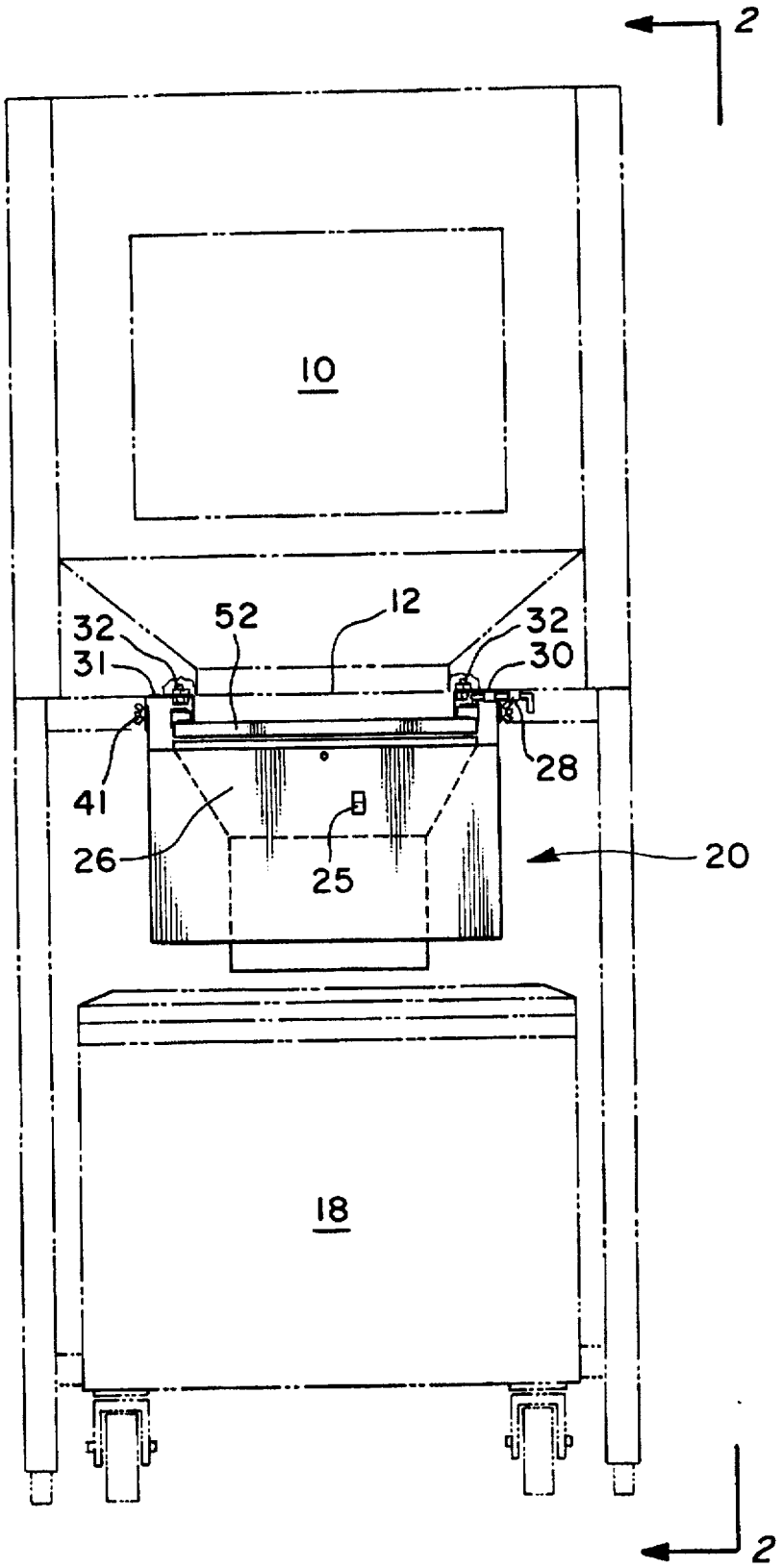
FIG. 1 is a front elevational view of the entire assembly. showing the path the ice 14 from the storage bin 10 through the ice crusher assembly.
Figure 2:
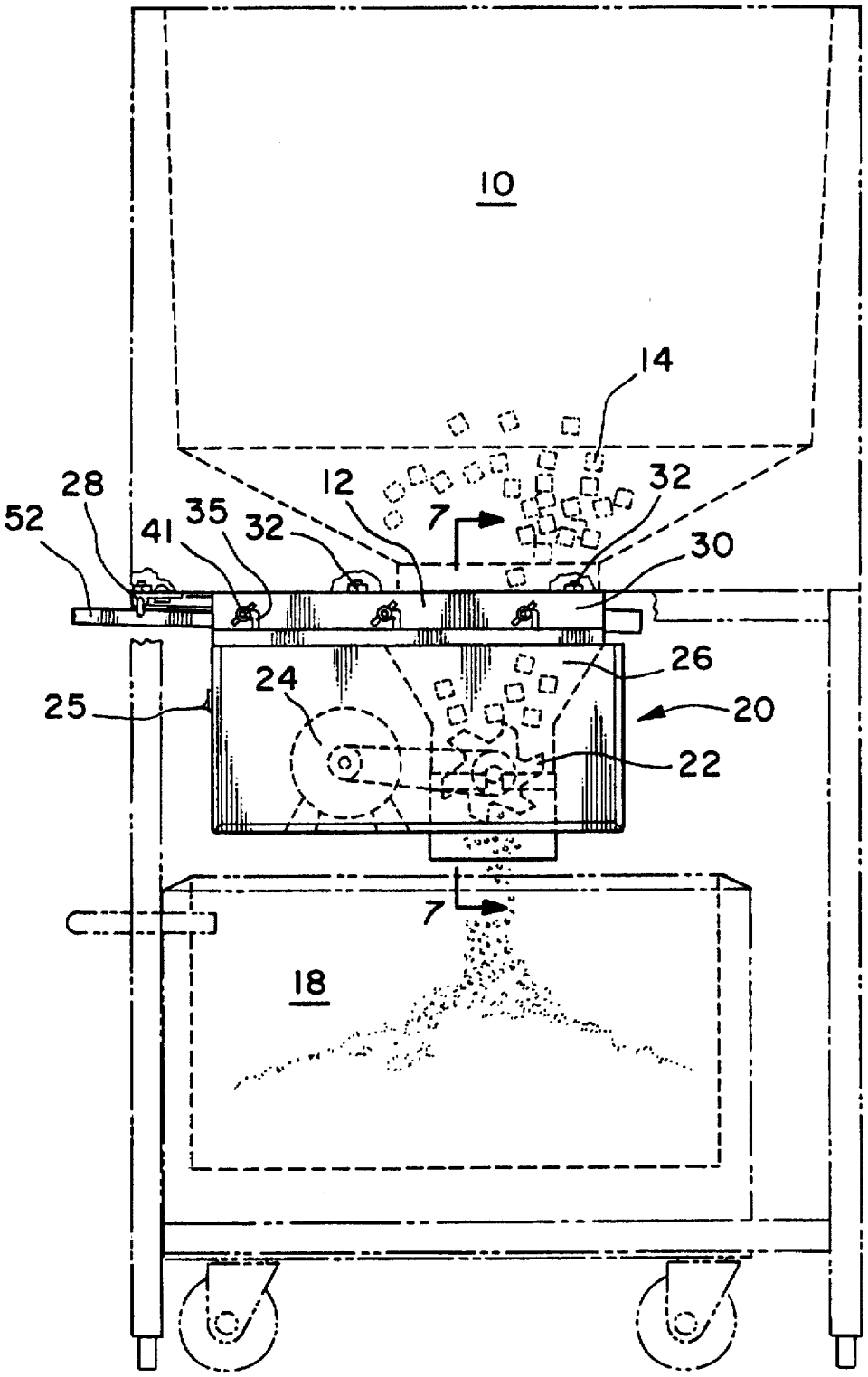
FIG. 2 is a right side elevational view of the entire assembly corresponding to FIG. 1.

Turning to FIGS. 1 and 2, front and side views are provided showing the entire ice storage unit with the ice crusher assembly 20. The ice storage unit has an ice storage bin 10 that is supported a distance above the floor so that a removable cart 18 can be placed beneath the unit to receive ice. The ice storage unit often includes an ice maker for creating ice cubes 14 and delivering them into the storage bin 10. The ice storage bin 10 is insulated and may also include a refrigeration unit to maintain a temperature below freezing within the ice storage bin 10. The ice storage bin 10 has a lower opening 12 that allows ice 14 to drop into the ice crusher assembly 20 and cart 18 below, as illustrated in FIG. 2.

Figure 7:
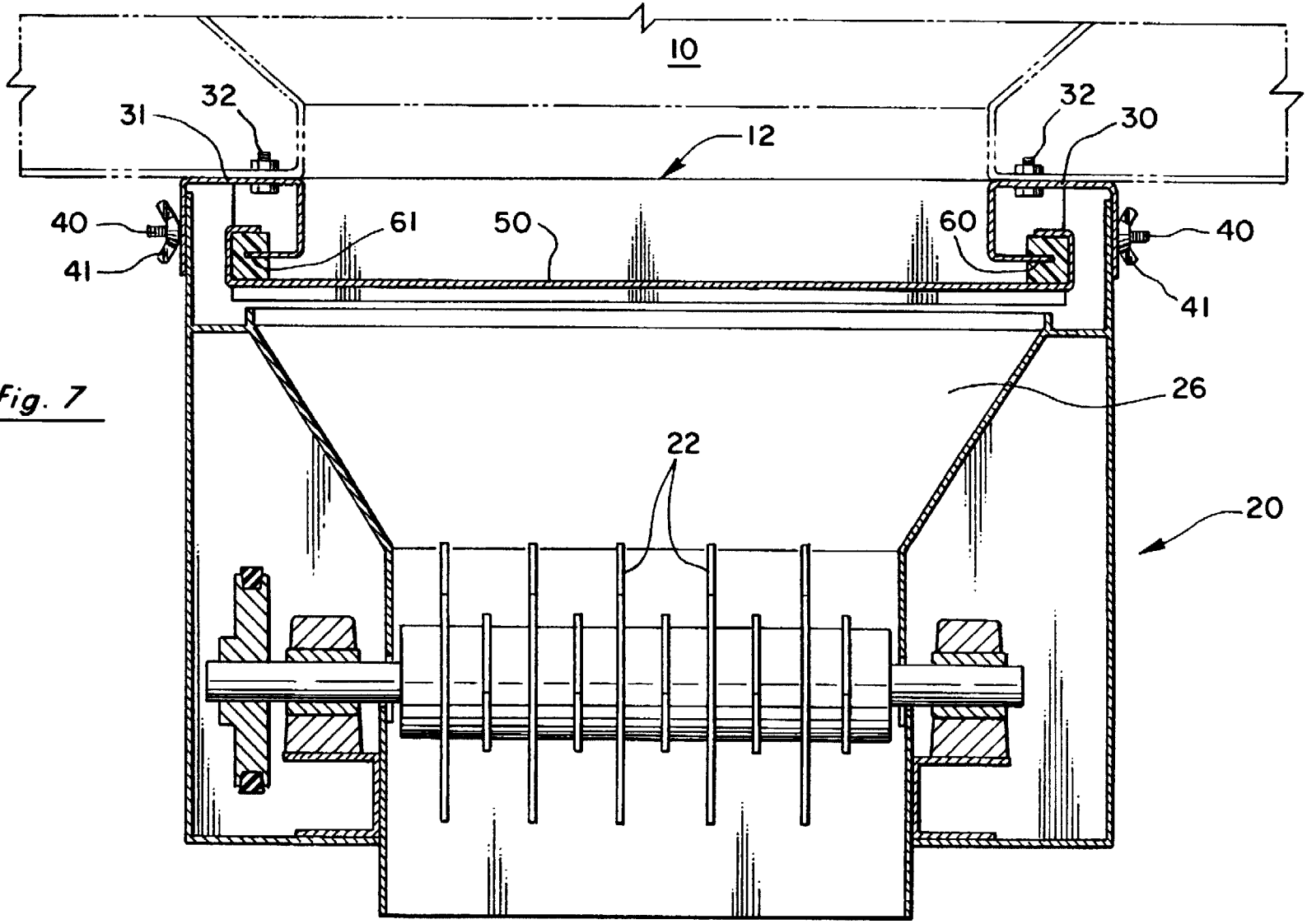
FIG. 7 is a cross-sectional view of the lower portion of the ice storage bin 10, bracket tracks 30 and 31, gate 50, and ice crusher 20.

As shown in FIGS. 2 and 7, the ice crusher 20 has a number of rotating blades 22 mounted on a shaft that is driven by an electric motor 24. A vertical inlet chute 26 leads into the ice crusher assembly 20. Under normal operating conditions, the upper opening of this inlet chute 26 is aligned with lower opening 12 of the ice storage bin 10 and directs the flow of ice 14 through the ice crusher blades 22 and into the cart 18. The entire ice crusher assembly is contained within a compact, modular housing for increased safety and to facilitate removal and cleaning.

The ice crusher assembly 20 is mounted below this lower opening 12 by means of two parallel bracket tracks 30, 31 secured on opposing sides of the lower opening 12 of the ice storage unit. For example, the bracket tracks 30, 31 can be fastened to the underside of the ice storage compartment by means of a series of bolts 32.

Figure 6:
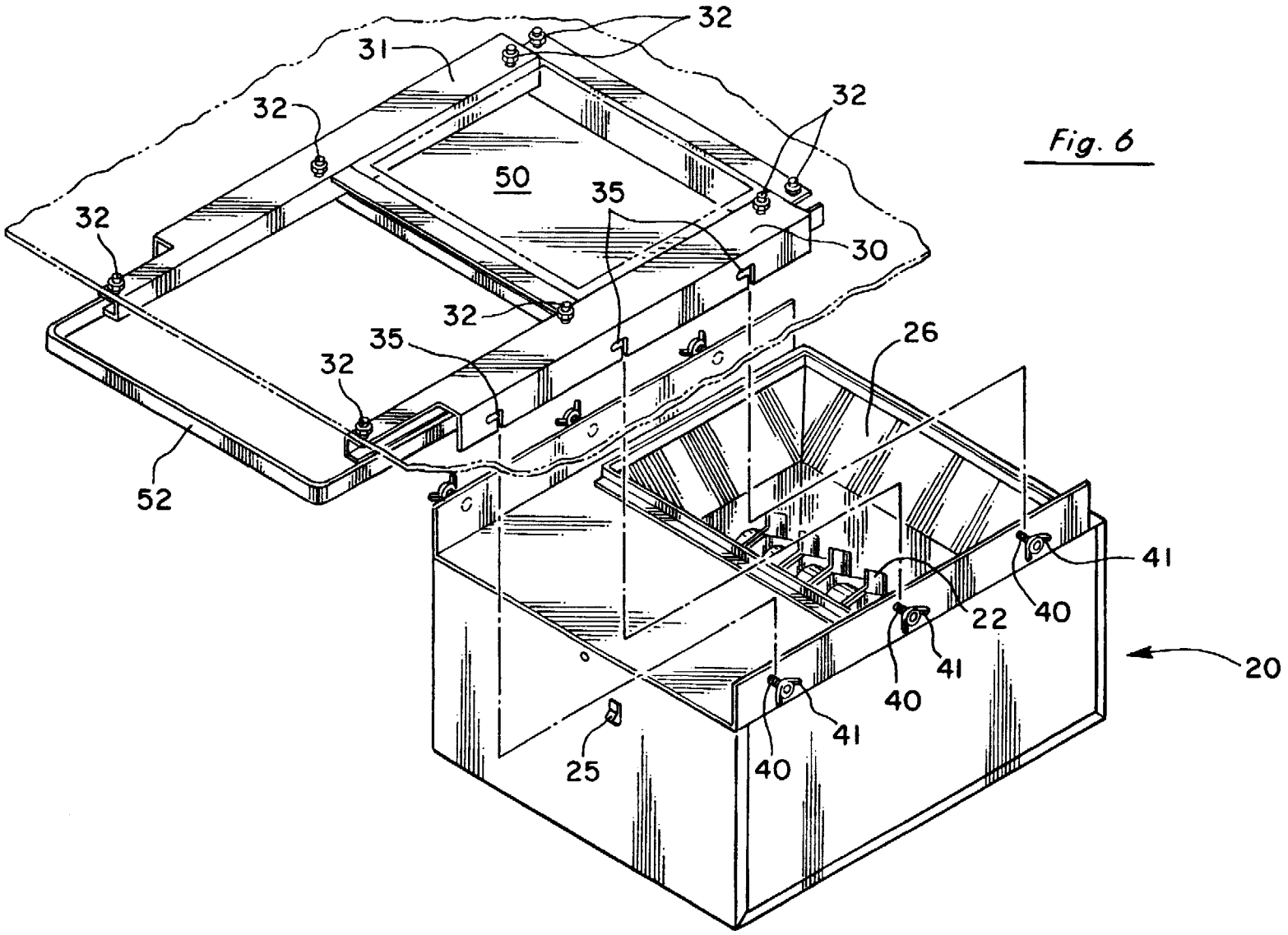
FIG. 6 is an exploded, front perspective view of the bracket tracks 30 and 31, gate 50, and ice crusher 20.

In the one embodiment of the present invention, the bracket tracks 30, 31 include a series of inverted L-shaped slots 35, as shown in FIG. 6. A corresponding series of pins 40 extend laterally outward from the upper section of the ice crusher housing and engage these slots 35. The arrangement of the slots and pins could be reversed so that the pins extend laterally inward from the bracket tracks to engage L-shaped slots in the ice crusher housing.

During normal operation, the pins remain in the horizontal portions of the slot, and thereby support the ice crusher 20 in beneath the ice storage unit 10. In this first position, the upper opening of the inlet chute 26 to the ice crusher 20 is vertically aligned with the lower opening 12 of the ice storage unit 10 to receiving ice 14 to be chipped, as shown in FIG. 2. To remove the ice crusher, the user manually slides the ice crusher 20 forward a small distance to a second position in which the pins 40 enter the vertical portions of the L-shaped slots 35. Once the pins 40 are aligned in the vertical portions of the slots, the ice crusher 20 will drop off the bracket tracks 30, 31, as shown in FIG. 6. The operator can manually support the ice crusher 20 when it is released from the bracket tracks to prevent from crashing to the floor.

In the embodiment shown in the drawings, the pins 40 are threaded and wing nuts 41 are employed to securely hold the pins in horizontal portions of the L-shaped slots 35 during normal operation. The ice crusher produces substantial vibrations and jolts that might otherwise cause the pins 40 to accidentally slide relative to the bracket tracks 30, 31. The wing nuts 41 must be manually loosened before the ice crusher 20 can be removed from the bracket tracks 30 and 31.

It should be expressly understood that other release mechanisms could also be substituted for the pins and slots, such as a system of sliding tracks similar to those used for kitchen drawers and desk drawers, that would allow the ice crusher 20 to slide forward and drop off the bracket tracks 30, 31. Another alternative would be to use clips or removable pins.

Figure 3:
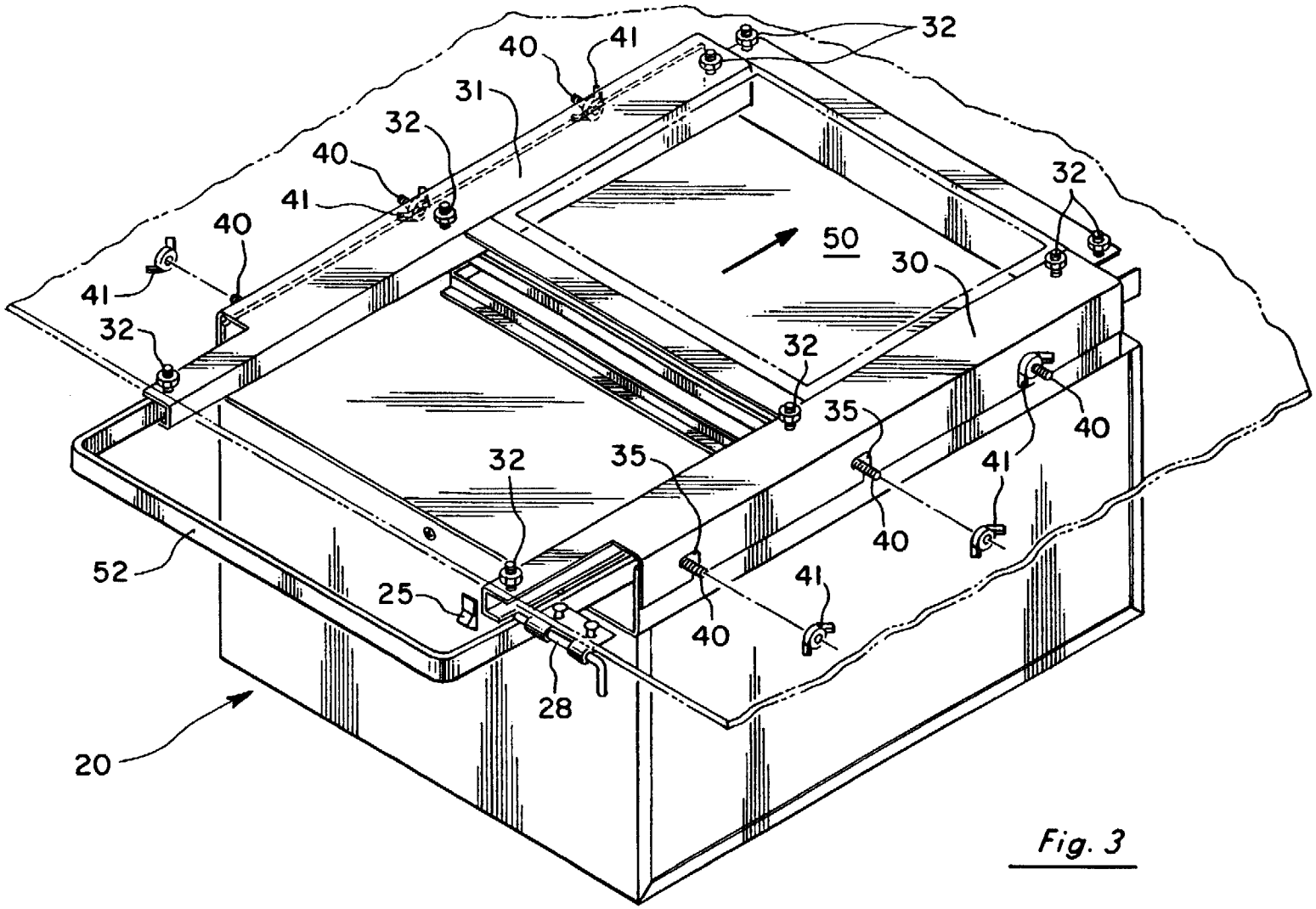
FIG. 3 is a front perspective view of the ice crusher assembly with the gate 50 closed.
Figure 4:
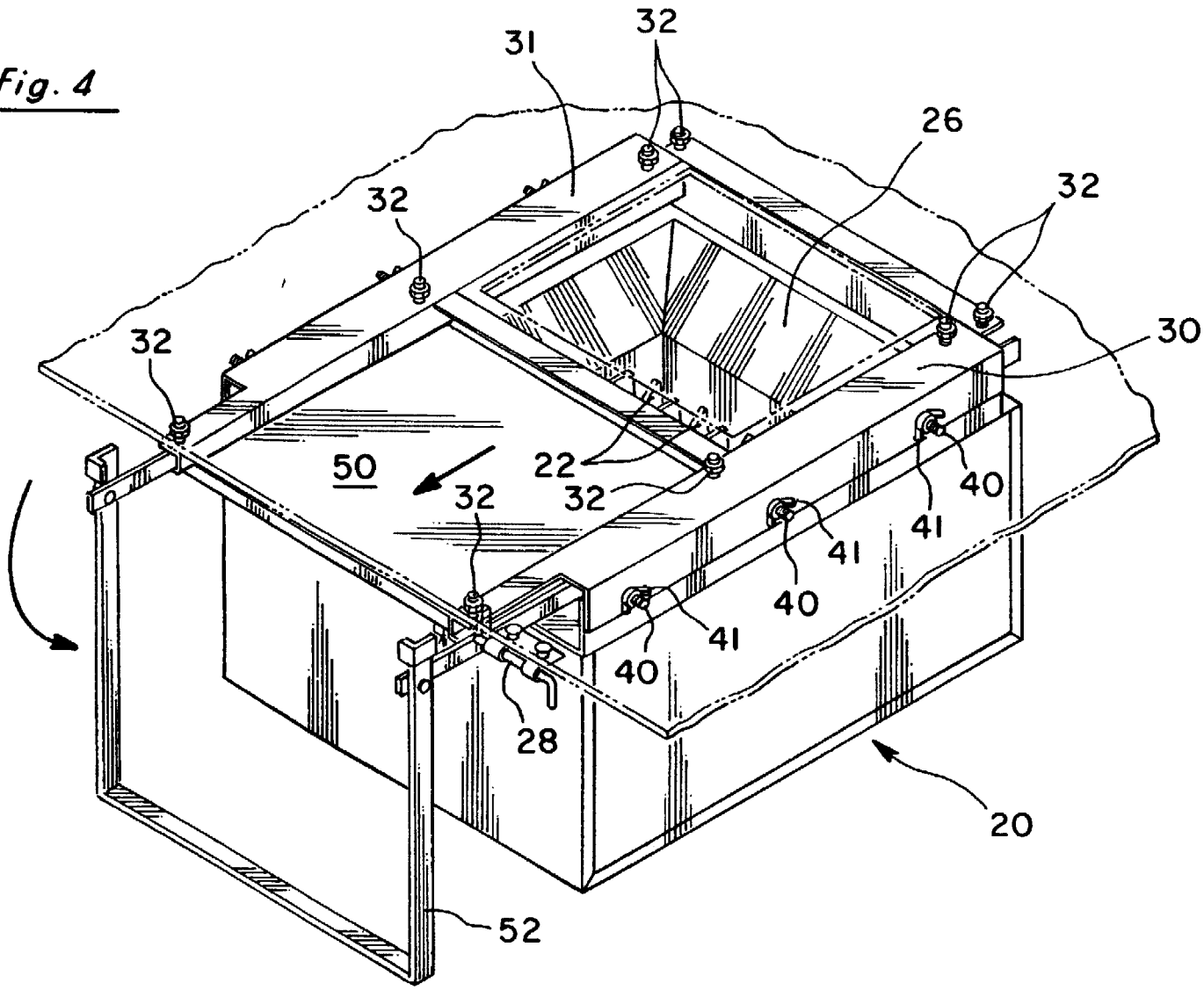
FIG. 4 is a front perspective view of the ice crusher assembly corresponding to FIG. 3 with the gate 50 open.
Figure 5:
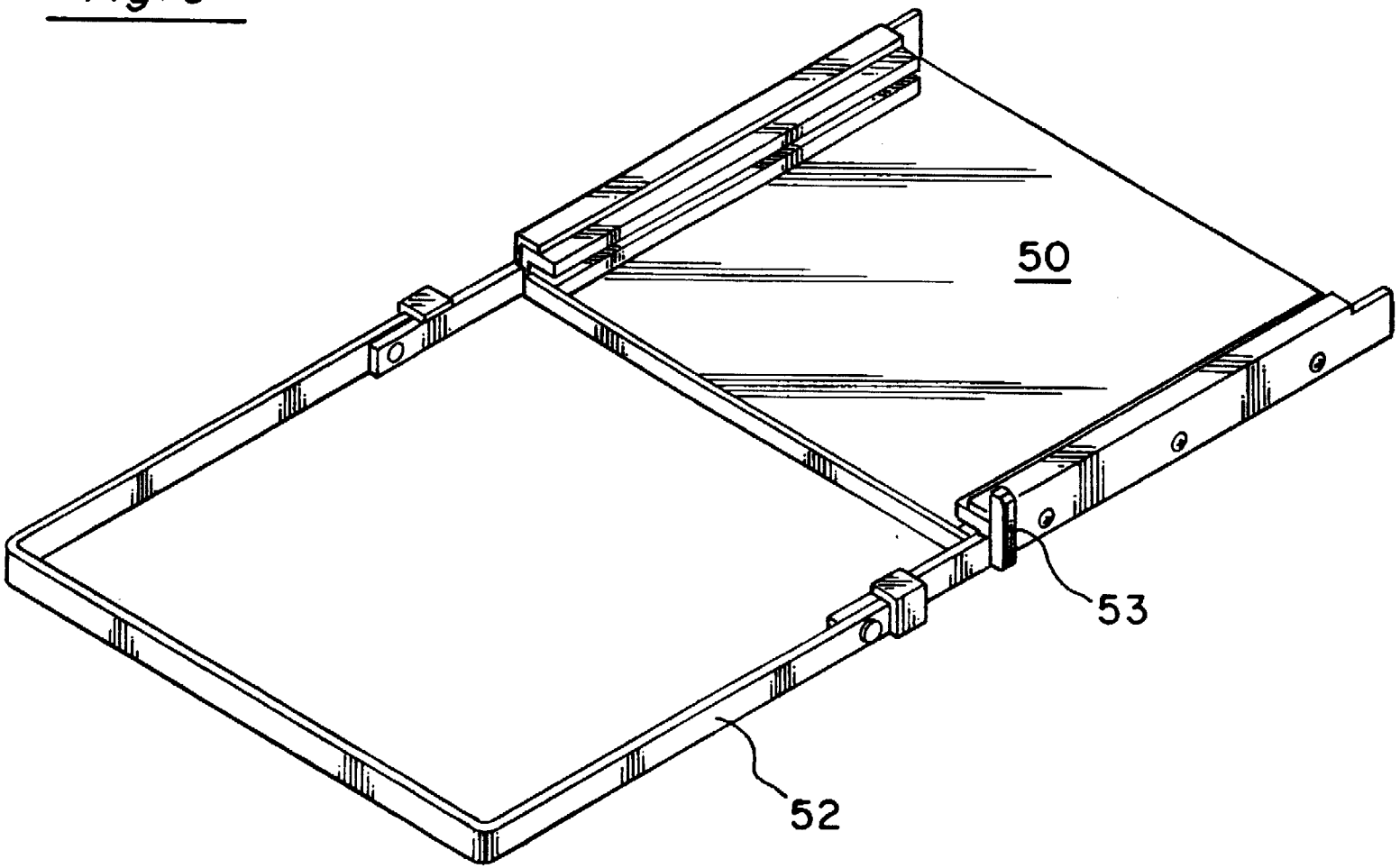
FIG. 5 is a front perspective view of the gate 50 and gate handle 52.

The movable gate 50 is illustrated in FIG. 5. The gate is held between two parallel gate tracks 60, 61 extending along opposing sides of the upper portion of the ice crusher housing as shown in FIGS. 3, 4, and 7. The gate 50 can slide along the gate tracks 60 and 61 to selectively open and close the lower opening 12 of the ice storage unit and thereby control the flow of ice 14 into the ice crusher 20. The closed position for the gate 50 is shown in FIG. 3 and the open position is depicted in FIG. 4. The gate 50 can be a substantially planar piece of sheet metal as shown in the drawings. In the preferred embodiment, the gate 50 is slanted slightly rearward to cause water draining from the ice storage bin to flow into a drain at the rear of the unit. Alternatively, the gate 50 could be equipped with rearward sloping draining channels to accomplish the same result.

A handle 52 extends across the front of the gate 50 for easier manual operation of the gate assembly. The handle 52 can be folded as depicted in FIG. 4 for convenience when the gate 50 pulled forward to the open position.

An interlock mechanism 28 limits the forward range of motion of the gate during normal use, and thereby prevents the gate 50 from being accidentally pulled so far forward that it is no longer engaged by the gate tracks 60 and 61. In the embodiment shown in the FIGS. 3, 4, and 5, a tab 53 extends upward from one side of the gate 50. A latch 28 with a sliding pin is mounted to the front of the ice crusher housing. In its normal extended position, the latch pin blocks the tab 53 and prevents the gate 50 from sliding forward beyond the point of contact. The latch pin can be manually retracted to permit removal of the gate 50 from the gate tracks 60 and 61 for cleaning.

The gate assembly normally remains in place when the ice crusher 20 is removed from the bracket tracks 30, 31 to prevent ice 14 from spilling out of the ice storage bin 10. However, a major advantage of the present invention is the ability to separately and independently remove either the ice crusher or the gate assembly.

The above disclosure sets forth a number of embodiments of the present invention. Other arrangements or embodiments, not precisely set forth, could be practiced under the teachings of the present invention and as set forth in the following claims.

I claim:

1. An ice crusher assembly for use in conjunction with an ice storage unit having an opening for removal of ice from the ice storage unit, said ice crusher assembly comprising:

an ice crusher;

a bracket mounted to the ice storage unit supporting said ice crusher below the opening of the ice storage unit;

a gate selectively opening and closing the opening of the ice storage unit; and release means for allowing said ice crusher to slide relative to said bracket between a first position in alignment with the opening of the ice storage unit for receiving ice to be chipped, and a second position in which said ice crusher can be removed from said bracket.

2. The ice crusher assembly of claim 1 wherein said release means comprise a plurality of inverted L-shaped slots in said bracket and a corresponding plurality of pins extending from said ice crusher for engaging said slots.

3. The ice crusher assembly of claim 1 wherein said release means comprise a plurality of L-shaped slots in said ice crusher and a corresponding plurality of pins extending from said bracket for engaging said slots.

4. The ice crusher assembly of claim 1 wherein said ice crusher further comprises an inlet chute and wherein said bracket comprises two parallel bracket tracks mounted on opposite sides of the opening of the ice storage unit for engaging said inlet chute.

5. The ice crusher assembly of claim 4 further comprising two parallel gate tracks extending on opposing sides of said inlet chute for sliding engagement with said gate.

6. An ice crusher assembly for use in conjunction with an ice storage unit having an opening for removal of ice from the ice storage unit, said ice crusher assembly comprising:

an ice crusher having an inlet chute;

two parallel bracket tracks mounted on opposing sides of the opening to the ice storage unit supporting said ice crusher below the opening of the ice storage unit;

release means for allowing said ice crusher to slide between a first position in alignment with the opening of the ice storage unit for receiving ice to be chipped, and a second position in which said ice crusher can be removed from said bracket tracks;

two parallel gate tracks on opposing sides of said inlet chute; and a gate in sliding engagement between said gate tracks to selectively open and close said inlet chute.

7. The ice crusher assembly of claim 6 wherein said release means comprise a plurality of L-shaped slots in said inlet chute and a corresponding plurality of pins extending from said bracket tracks for engaging said slots.

8. The ice crusher assembly of claim 6 wherein said release means comprise a plurality of inverted L-shaped slots in said bracket tracks and a corresponding plurality of pins extending from said ice crusher for engaging said slots.

9. An ice crusher assembly for use in conjunction with an ice storage unit having a lower opening to allow ice to drop from the ice storage unit, said ice crusher assembly comprising:

an ice crusher having an inlet chute for receiving ice to be chipped;

two parallel bracket tracks mounted on opposing sides of the lower opening of the ice storage unit;

a plurality of L-shaped slots extending from at least one of said ice crusher and said bracket tracks;

a corresponding plurality of pins extending from at least one of said ice crusher and said bracket tracks in sliding engagement with said slots, said ice crusher sliding between a first position in vertical alignment with the lower opening of the ice storage unit for receiving ice to be chipped and a second position in which said ice crusher can be removed from said bracket tracks;

two parallel gate tracks on opposing sides of said inlet chute; and a gate in sliding engagement along said gate tracks to selectively open and close said inlet chute to said ice crusher.

10. The ice crusher assembly of claim 9 wherein said slots are in said ice crusher and said pins extend from said bracket tracks.

11. The ice crusher assembly of claim 9 wherein said slots are in said bracket tracks and said pins extend from said ice crusher.

12. An ice crusher assembly for use in conjunction with an ice storage unit having a lower opening to allow ice to drop from the ice storage unit, said ice crusher assembly comprising:

an ice crusher having an inlet chute for receiving ice to be chipped;

two parallel bracket tracks mounted on opposing sides of the lower opening of the ice storage unit and having a plurality of inverted L-shaped slots; and a plurality of pins extending laterally outward from said ice crusher in sliding engagement with said slots, said ice crusher sliding between a first position in which said inlet chute is in vertical alignment with the lower opening of the ice storage unit for receiving ice to be chipped and a second position in which said ice crusher can be removed from said bracket tracks.

13. The ice crusher assembly of claim 12 further comprising:

two parallel gate tracks on opposing sides of said inlet chute; and a gate in sliding engagement along said gate tracks to selectively open and close said inlet chute.

* * * * *